US006044617A

United States Patent [19]

Finkowski et al.

[11] Patent Number: 6,044,617

[45] Date of Patent: Apr. 4, 2000

[54] DOUGH PACKING MACHINE WITH TILTABLE SPOONS

[75] Inventors: James W. Finkowski, Andover; Robert F. Meyer, Maple Grove, both of Minn.

[73] Assignee: The Pillsbury Company, Minneapolis, Minn.

[21] Appl. No.: 09/072,439

[22] Filed: May 4, 1998

[51] Int. Cl.[7] ..... B65B 25/16; B65B 39/06; B65B 39/14

[52] U.S. Cl. ..... 53/255; 53/260; 53/570

[58] Field of Search ..... 53/255, 257, 260, 53/258, 566, 570, 253, 252, 251, 235, 390, 391, 392, 468, 467, 473

[56] References Cited

U.S. PATENT DOCUMENTS

| | | | |
|---|---|---|---|
| 945,572 | 1/1910 | Murray | 53/255 |
| 3,161,003 | 12/1964 | Grintz | 53/255 |
| 3,270,485 | 9/1966 | Knepper | 53/255 |
| 3,458,970 | 8/1969 | Reid et al. | 53/159 |
| 4,982,556 | 1/1991 | Tisma | 53/251 X |
| 5,048,266 | 9/1991 | Wieckowicz | 53/469 |
| 5,685,127 | 11/1997 | Finkowski | 53/255 |

FOREIGN PATENT DOCUMENTS

WO 93/21068 10/1993 WIPO .

*Primary Examiner*—James F. Coan
*Attorney, Agent, or Firm*—Westman, Champlin & Kelly

[57] ABSTRACT

An apparatus for loading dough into a container through a container opening includes a support frame having a cam rail. An endless band is rotatable on the support frame and includes a plurality of tilting spoon assemblies mounted to the band. Each tilting spoon assembly includes a support member, a spoon, a hinge, and a push bar. The hinge joins an end of the spoon to the support member. The push bar selectively tilts the spoon from a first position to a second position relative to the support member. The push bar has a first end joined to the spoon, positioned between the hinge and a second end of the spoon remote from the first end. A second end of the push bar engages the cam rail. The cam rail includes bends to cause selective displacement of the push bar to tilt the spoon from the first position to the second position.

24 Claims, 8 Drawing Sheets

26A
26
38
60
10
27B
28
20
27
27A
31A
12
50
74
31B
37
77B
80
70
82
98
96
76
88
84
77A
86
38
60
26A
26
26B
28
20

DOUGH PACKING MACHINE WITH TILTABLE SPOONS

BACKGROUND OF THE INVENTION

The present invention relates to continuous dough processing lines. More particularly, the present invention relates to an apparatus for inserting or packing dough into containers.

Apparatuses for inserting dough into containers are generally known. U.S. Pat. No. 3,458,970 to Reid, et al., discloses one such packing apparatus. The dough packing apparatus of Reid, et al., includes a mechanism for rolling and slitting a dough sheet to form a plurality of longitudinally aligned adjacent rolls of dough; and a receiving mechanism for grouping the dough pieces, for example, in pairs, and for providing a predetermined space in between single pieces. In a form of the apparatus, the receiving mechanism includes a pair of vertically spaced endless conveyors with receiving cups on one side of the edges of the lower conveyor for initially holding the pieces. An upper conveyor is obliquely mounted and is adapted to contact the upper surfaces of the pieces located in the cups when they have reached a predetermined position, and thereafter roll them to the lower conveyor to the opposite edge thereof. From the edge of the lower conveyor, the dough pieces fall to an indexing drum which, in turn, retains them for a predetermined period of time and then transfers them to one of several supporting and guiding spoons mounted on an endless loading conveyor. A container dispenser provides containers to the loading conveyor which includes a provision for supporting the containers in position to receive the rolls from the spoons.

The spoons are arranged on the conveyor so as to lie generally perpendicular to the conveying direction. Specifically, fixed plates are mounted to the endless conveyor along each edge. A hinge mounts a supporting bracket to each of the plates. The supporting bracket supports a spoon generally over each respective plate. A container support is mounted to the supporting bracket at a discharge end of the spoon. A follower is secured to a free end of the supporting bracket remote from the hinge. The follower engages a stationary guide rail provided along the frame of the dough packing apparatus. The stationary guide rail includes bends such that its position varies with respect to the support frame along the longitudinal length of the support frame. The stationary guide rail controls the position of the follower and, thus, the support bracket attached thereto, so that as the follower rises and falls following the guide rail, the support bracket pivots on the hinge to tilt the spoon between an elevated position and a retracted position.

Although the general use of tilting spoons mounted to an endless conveyor to load dough pieces into containers performs satisfactorily, there is a need for a robust machine that will operate faster to allow increased production speeds.

SUMMARY OF THE INVENTION

An apparatus for loading dough into a container through a container opening includes a support frame having a cam rail. An endless band is rotatable on the support frame and includes a plurality of tilting spoon assemblies mounted to the band. Each tilting spoon assembly includes a support member, a spoon, a hinge, and a push bar. The hinge joins an end of the spoon to the support member. The push bar selectively tilts the spoon from a first position to a second position relative to the support member. The push bar has a first end joined to the spoon, positioned between the hinge and a second end of the spoon remote from the first end. A second end of the push bar engages the cam rail. The cam rail includes bends to cause selective displacement of the push bar to tilt the spoon from the first position to the second position.

DETAILED DESCRIPTION OF THE PREFERRED EMBODIMENTS

Figure 1:
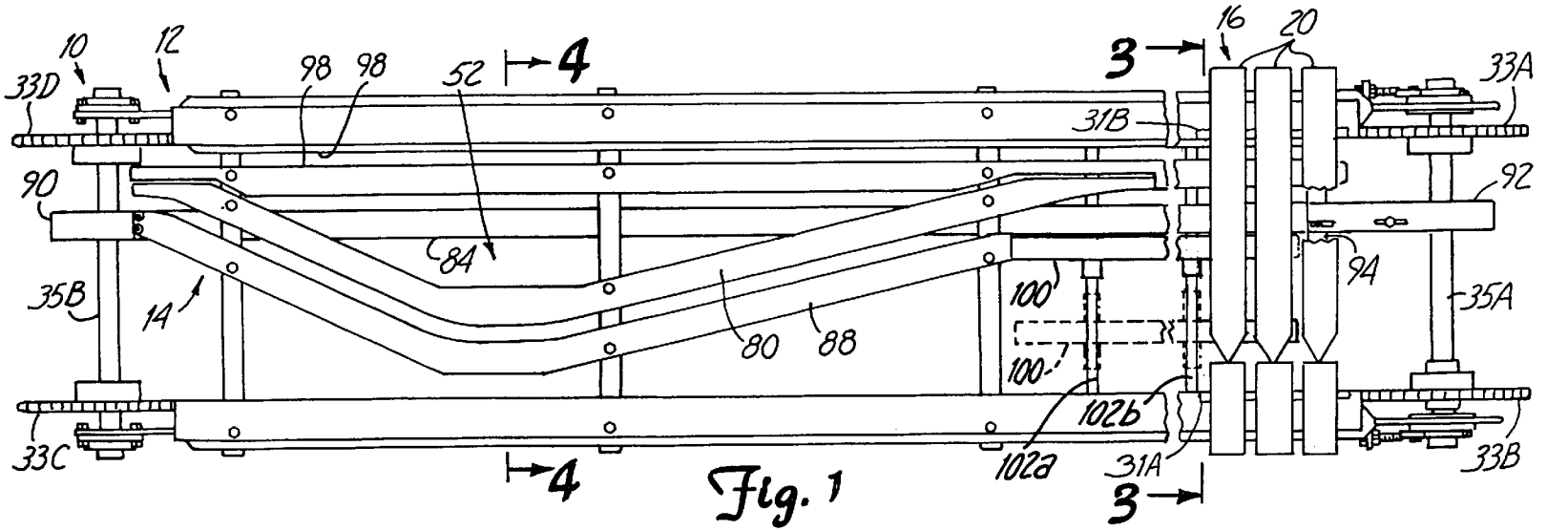
FIG. 1 is a top plan view of a dough packing apparatus of the present invention with portions removed.
Figure 2:
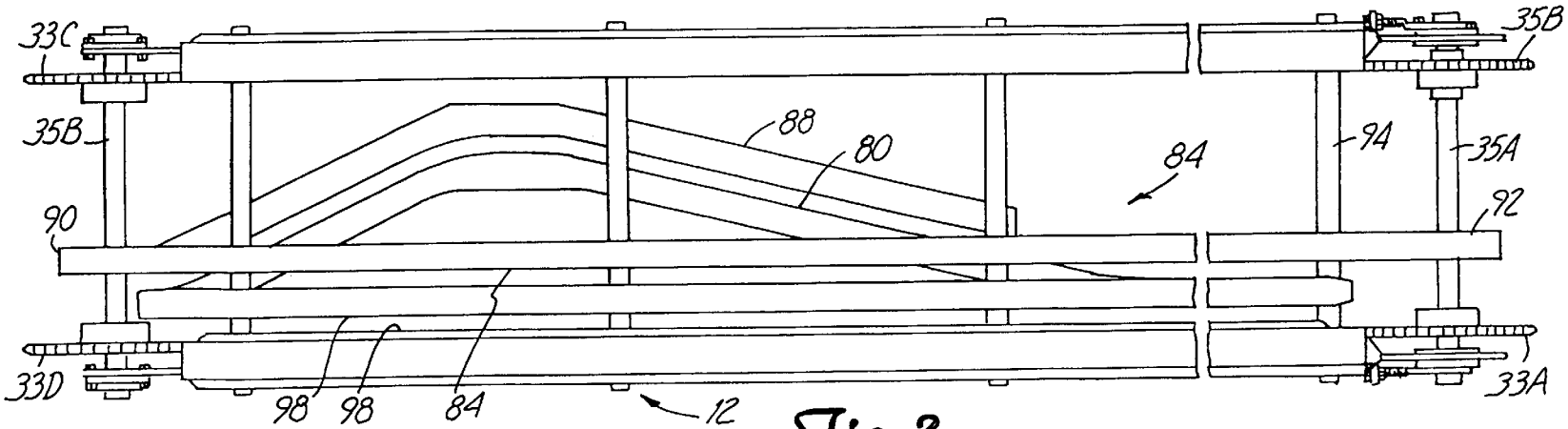
FIG. 2 is a bottom plan view of the dough packing apparatus with portions removed.

FIGS. 1–4 illustrate an embodiment of a dough packing apparatus 10 of the present invention. Generally, the dough packing apparatus 10 includes a support frame 12 having a cam rail 14, and an endless conveyor 16 that is rotatable on the support frame 12. The endless conveyor 16 is formed of a plurality of tilting spoon assemblies 20. In FIG. 1, most of the tilting spoon assemblies 20 have been removed in order to show other components of the dough packing apparatus 10. Preferably, a sufficient number of tilting spoon assemblies 20 are provided on the endless conveyor 16 so as to cover the endless conveyor 16 and allow continuous operation.

Figure 3:
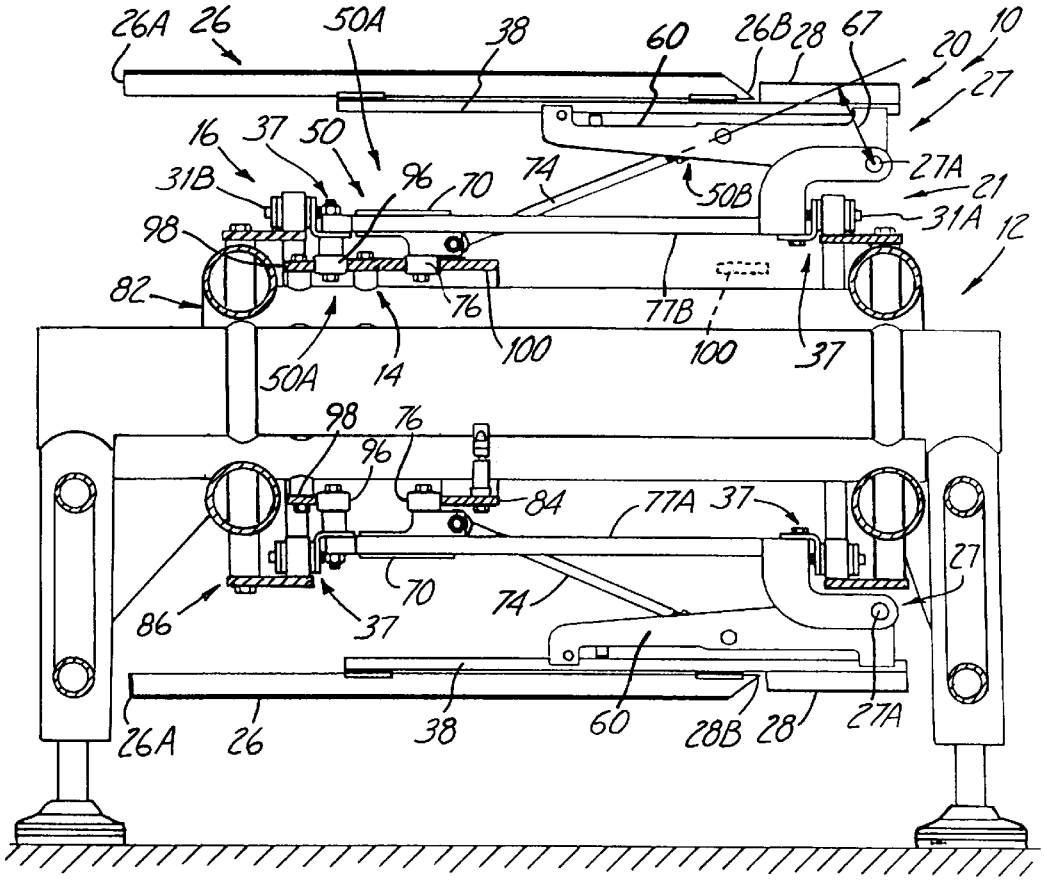
FIG. 3 is a sectional view of the dough packing apparatus, illustrating a tilting spoon in a retracted position.

Referring to FIG. 3, each tilting spoon assembly 20 includes a support member 21 secured to endless conveyor 16, a spoon 26, and a hinge 27 joining the support member 21 to the spoon 26. In the embodiment illustrated, the endless conveyor 16 comprises endless chains 31A and 31B disposed on opposite sides of the support frame 12. The chains 31A and 31B rotate on sprockets 33A, 33B, 33C, and 33D (FIG. 1) wherein sprockets 33A and 33B and sprockets 33C and 33D are joined together by common shafts 35A and 35B, respectively. A suitable driver device, such as an electric motor, drives one of the shafts 35A or 35B to rotate the endless conveyor 16. Each of the support members 21 is joined at opposite ends to the chains 31A and 31B with suitable mounting assemblies 37.

Figure 5:
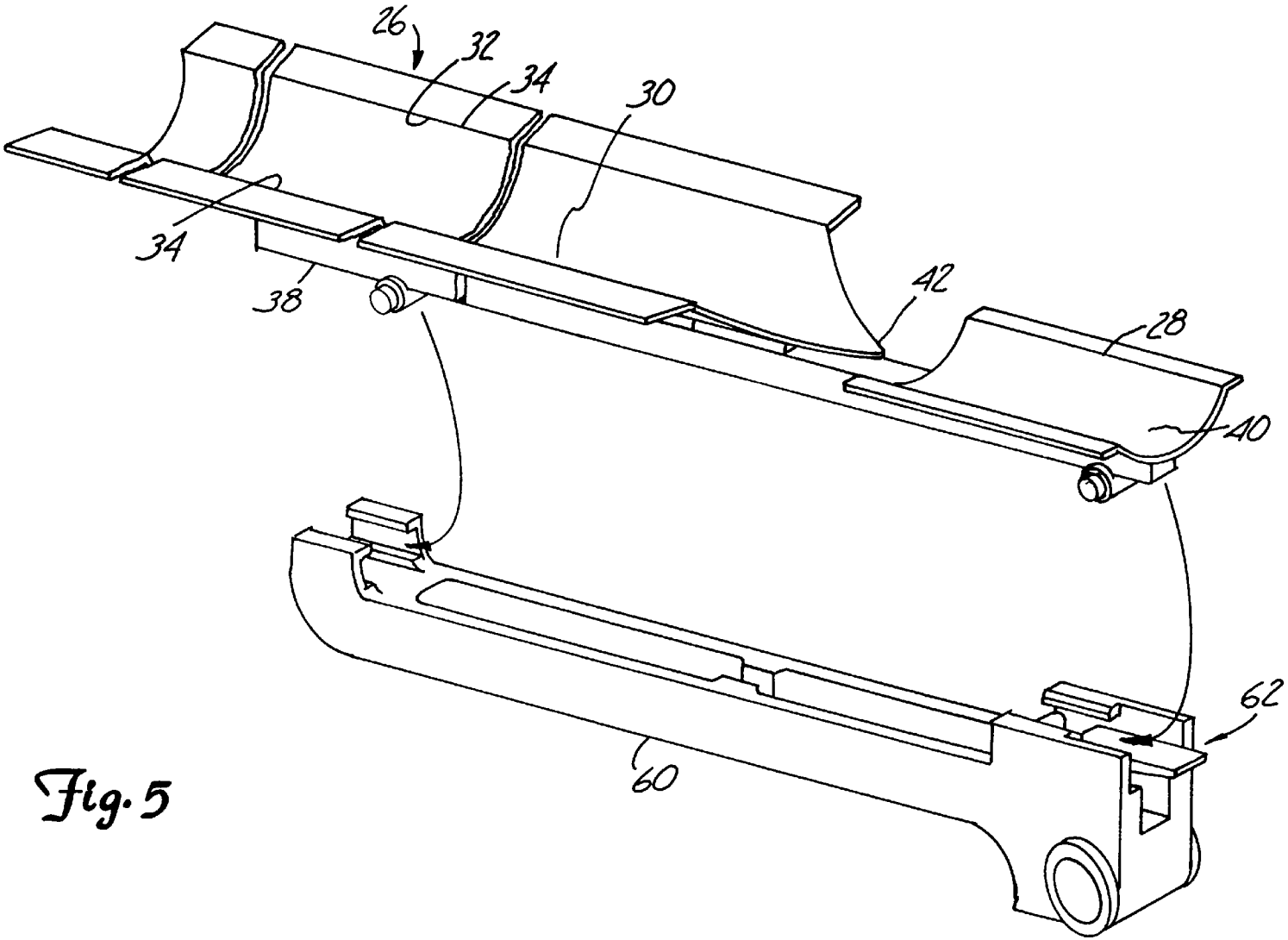
FIG. 5 is an exploded view of a tilting spoon.

Referring to FIG. 5, the spoon 26 is an elongated open trough having a longitudinal axis oriented generally perpendicular to the conveying direction when mounted to the support member 21. Dough to be packaged into a container is placed upon a lower surface 30 of the spoon 26 through an opening 32 formed between spaced-apart side walls 34 extending from the lower surface 30. In the embodiment illustrated, the spoon 26 is supported on a support rail 38 that also supports a container holder 28 which is aligned with the spoon 26 and mounted to the support rail 38. Preferably, the support rail 38 elevates the lower surface 30 of the spoon 26 above a lower surface 40 of the container holder 28 such that an extending tang 42 of the lower surface 30 can be inserted within an opening of a container (not shown) when the container has been placed on the container holder 28. An embodiment of the spoon 26 with the extending tang 42 is described in U.S. Pat. No. 5,685,127, entitled "UNIVERSAL SPOON FOR LOADING DOUGH INTO CONTAINERS," issued on Nov. 11, 1997, which is hereby incorporated by reference.

Figure 4:
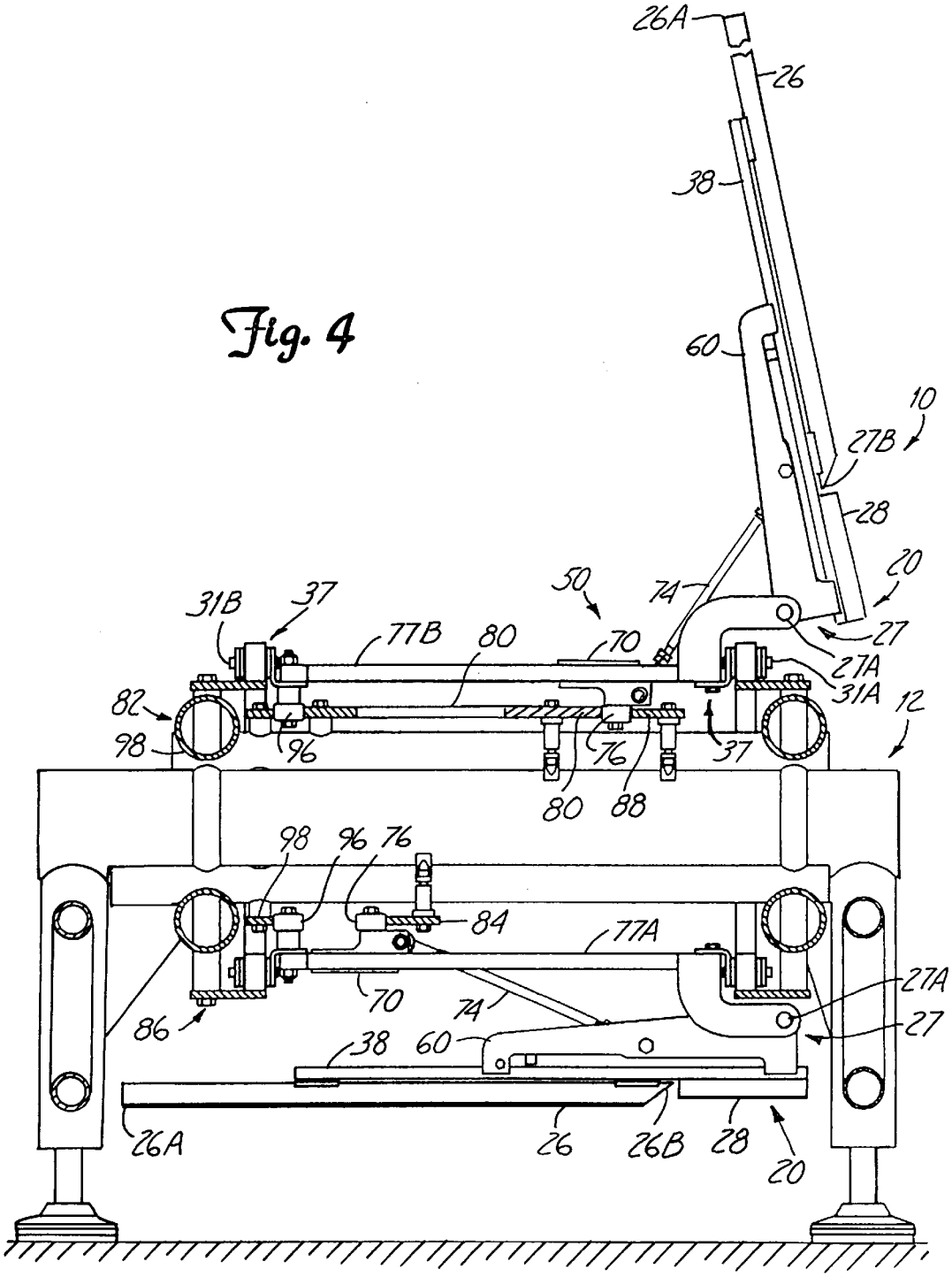
FIG. 4 is a sectional view of the dough packing apparatus with a tilting spoon in a tilted position.
Figure 8:
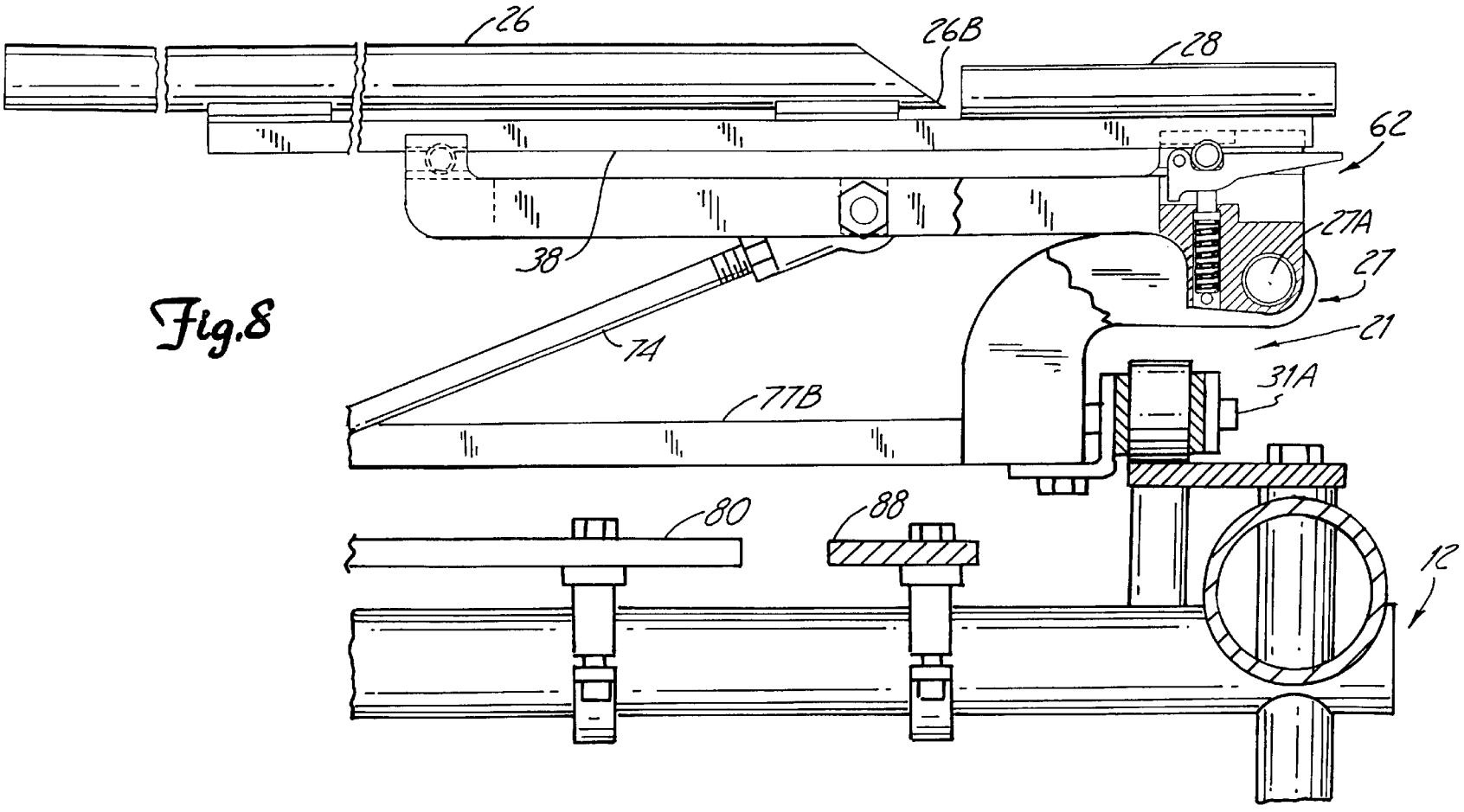
FIG. 8 is an enlarged sectional view of FIG. 3.

As illustrated in FIGS. 3 and 4, a push bar assembly 50 controls the pivoting motion of the spoon 26. In particular, the push bar assembly 50 lifts each respective spoon 26 from a first or retracted position (FIG. 3) to a second or tilted position (FIG. 4). Each push bar assembly 50 includes a first end 50A and a second end 50B. The end 50A engages the cam rail 14. The cam rail 14 includes bends which provide a portion 52 (FIG. 1) that causes displacement of the push bar assembly 50 to tilt the spoon 26 between the retracted position and the tilted position. The end 50B of each push bar assembly 50 is secured, in effect, to the spoon 26. In the embodiment illustrated, the end 50B is pivotally joined to a carriage 60. The carriage 60 forms one of the pivoting members of the hinge 27 and detachably receives the support rail 38. The carriage 60 includes a locking mechanism generally indicated at 62 in FIG. 8. The hinge 27 includes a pivot pin 27A that joins the carriage 60 to the support member 21. The carriage 60, the support rail 38, and the locking mechanism 62 are described in detail in the co-pending application Ser. No. 09/072,438, entitled "DETACHABLE SPOON FOR A DOUGH PACKING MACHINE" filed on even date herewith, which is incorporated herein by reference. When the support rail 38 is locked in place by the locking mechanism 62 to the carriage 60, the spoon 26 is effectively attached to the push bar assembly 50, wherein the end 50B of the push bar assembly 50 is positioned underneath the spoon 26 between the hinge 27 and an end 26A of the spoon 26 that is remote from a discharge opening 26B for the dough products. Location of the end 50B in this position provides a moment arm indicated by double arrow 67 in FIG. 3. Generally, a large moment arm 67 provides greater control as the spoon assembly 20 is tilted upwardly. However, a large moment arm 67 also reduces the overall inclination of the spoon assembly 20 in the tilted position. The length of moment arm 67 is selected based on the product to be packaged, the operating speed of the dough packing apparatus 10 and the desired maximum inclination of the spoon 26.

Figure 6:
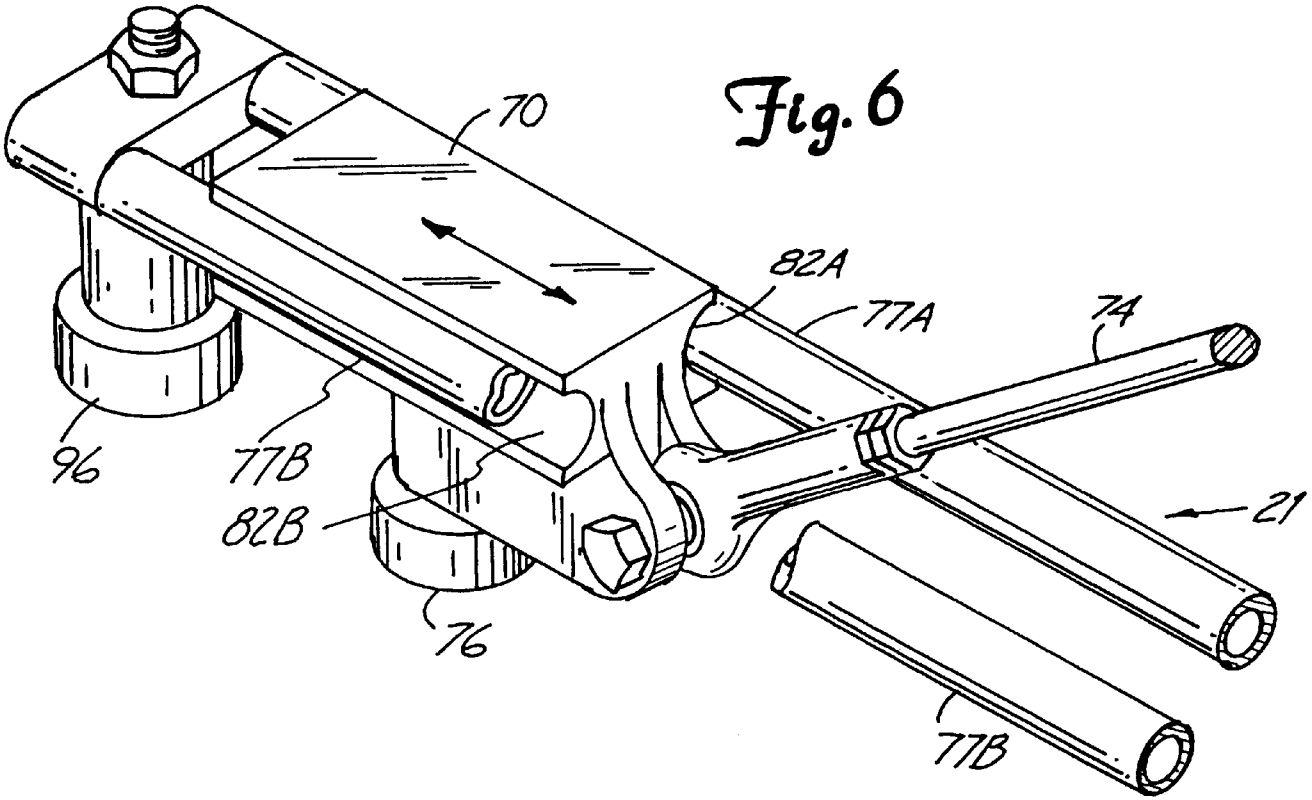
FIG. 6 is perspective view of a pusher bar assembly with portions removed.
Figure 7:
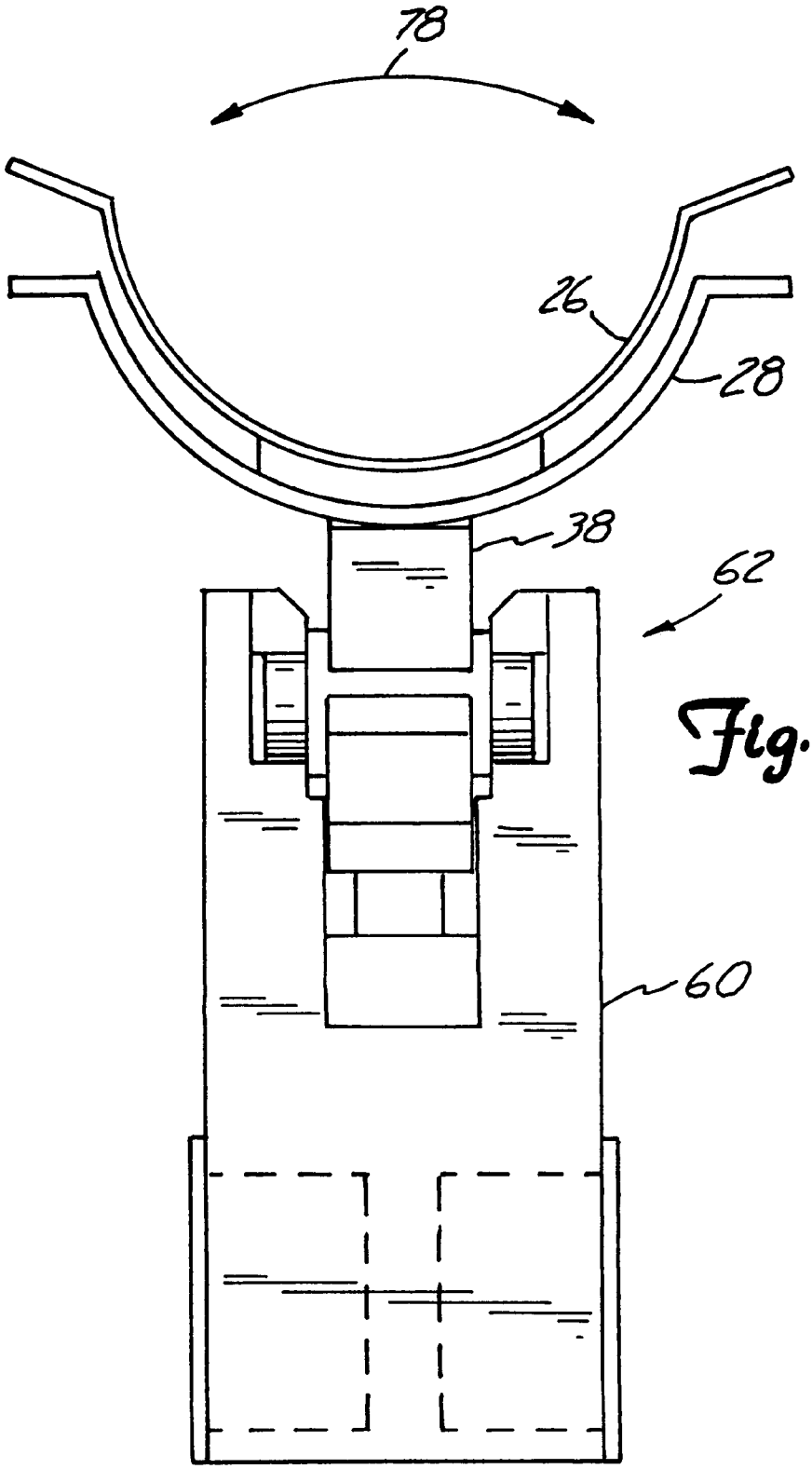
FIG. 7 is an end view of a tilting spoon.

In the illustrative embodiment of FIG. 6, the push bar assembly 50 includes an end member 70 (herein embodied as a slide assembly) and a push bar 74. The slide assembly 70 slides upon the support member 21 and includes a guide roller 76 that engages the cam rail 14. The push bar 74 is pivotally joined to the slide assembly 70 to allow the push bar 74 to pivot with tilting movement of the associated spoon 26. In a preferred embodiment, the slide assembly 70 and the support member 21 are designed to inhibit rocking motion of the spoon 26 on the support member 21 in directions indicated generally by double arrow 78 in FIG. 7. In particular, the cam rail 14 in the portion 52 (FIG. 1) is of sufficient length so as to gradually lift the spoon 26 from the retracted position of FIG. 3 to the tilted position of FIG. 4. By lengthening out the portion 52 of the cam rail 14 that lifts the spoon 26 to the tilted position, the angular speed of the spoon 26 is reduced.

In the embodiment illustrated in FIG. 6, the support member 21 includes two parallel spaced-apart rods 77A and 77B. The rods 77A and 77B are slidably disposed in recesses 82A and 82B (which could also be bores), respectively, provided in the slide assembly 70. The push bar 74 extends between the rods 77A and 77B. In an alternative embodiment, the support member 21 can include suitable surfaces that mate with opposed surfaces formed in a recess or bore of the slide assembly 70 so that rocking motion of the slide assembly 70 on the support assembly 24 is inhibited. For instance, the support member 21 can have outer surfaces in cross-section, corresponding to a rectangle, while complimentary surfaces are provided in the sliding assembly 70. In yet another embodiment, the support member 21 can include a suitable channel within which the slide assembly 70 can move.

Referring back to FIGS. 1–4, the cam rail 14 preferably includes a first cam rail portion 80 disposed on an upper section 82 of the support frame 12, and a second cam rail portion 84 disposed on a lower section 86 of the support frame 12. As illustrated, the first cam rail portion 80 includes the portion 52, which causes displacement of the slide assembly 70 in order to tilt or lift the spoons 26. The cam rail portion 80 varies only in two dimensions or in a plane, unlike prior art dough packing machines which have a rail that varies in three dimensions. Stated another way, the cam rail portion 80 lies in a plane that is parallel to a conveying plane of the conveyor defined by the longitudinal axes of the spoons 26 in the retracted positions. Since the cam rail portion 80 varies only in two dimensions, it can be easily manufactured to specified dimensions in order to cause tilting of the spoons 26 at desired velocities. Furthermore, location of the cam rail portion 80 below the tilting spoon assemblies 20 provides a compact assembly.

In the embodiment illustrated, the cam rail 14 further includes a rail portion 88 spaced-apart from the cam rail portion 80. At high operating speeds, the guide roller 76 may have a tendency to disengage from the cam rail portion 80 due to angular momentum of the spoon 26 and associated components. The rail portion 88 is in parallel with the rail portion 80 in the portion 52 to trap the guide roller 76 therebetween and inhibit substantial movement of the guide roller 76 away from the cam rail portion 80.

Figure 9:
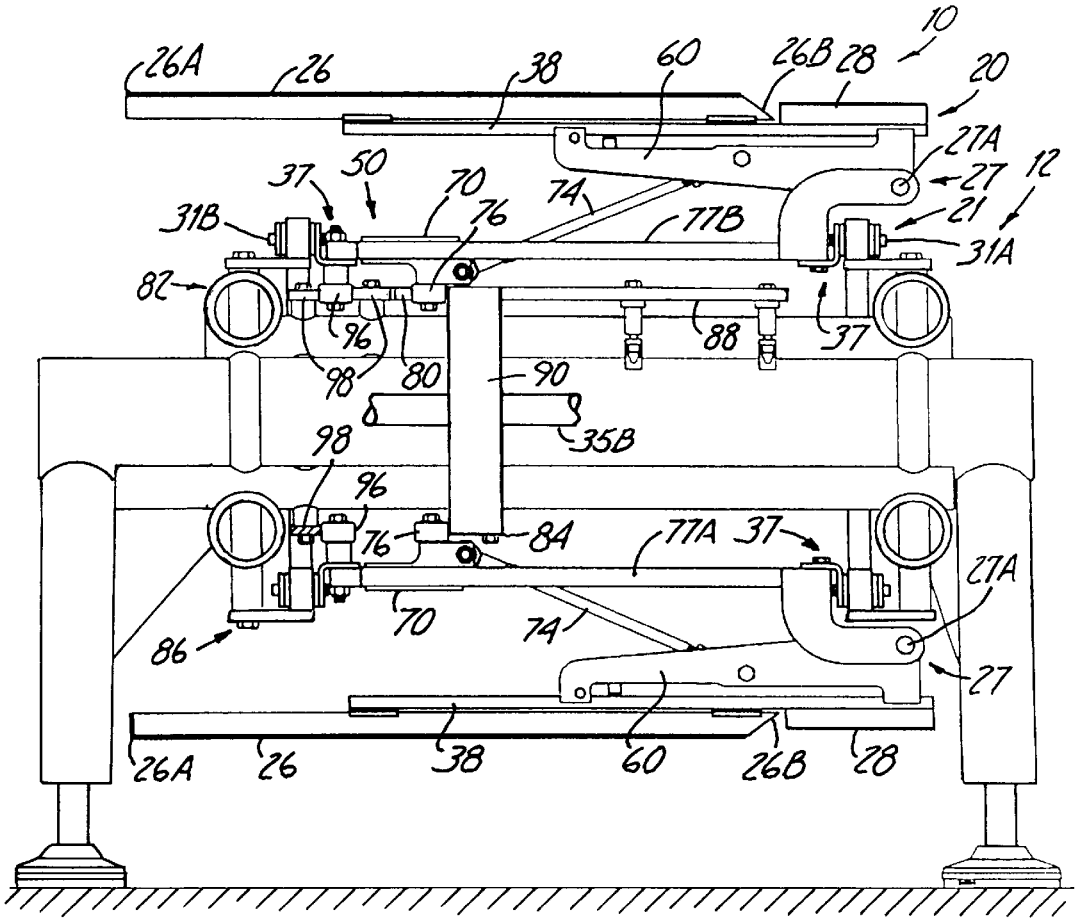
FIG. 9 is a side elevational view of the dough packing apparatus with portions removed.

The lower rail portion 84 retains the spoons 26 in retracted position (FIG. 3) against the force of gravity as the spoon assemblies 20 are conveyed upside down on the support frame 12. Referring to FIGS. 1 and 9, the lower rail portion 84 and upper rail portion 80 are joined together by end rail portion 90, which bends around shaft 35B. In this manner, the rollers 76 remain in continuous contact with the cam rail 14 to hold the spoons 26 in the retracted position. A similar end portion 92 is provided around shaft 35A, which, in the embodiment illustrated, is integrally formed with portion 84. Although illustrated wherein the upper rail portion 80, the rail portion 88, the lower rail portion 84, and end rail portions 90 and 92 are formed as plates with suitable bends in the portion 52 and at the ends of the support frame 12, and are secured to the support frame 12 with suitable fasteners, the cam and guide surfaces can be provided in other structures such as channels formed in suitable guide structures.

In the embodiment illustrated, a second guide roller 96 is secured to at least some of the support members 21 at spaced-apart intervals. The guide rollers 96 engage parallel guide rails 98. The guide rollers 96 help maintain the support members 21 and the spoons 26 attached thereto substantially normal to the conveying direction during planar movement in the conveying direction on the upper section 82 and during planar movement in a direction opposite to the conveying direction on the lower section 86.

Referring back to FIG. 1, a displaceable rail portion 100 is provided to retain the spoon assemblies 20 in the retracted position of FIG. 3 when the spoon assemblies are being conveyed toward the portion 52. In the position illustrated with solid lines, the displaceable portion 100 prevents each of the slide assembly 70 in contact therewith from sliding toward the hinge 27 on each of the corresponding rods 77A and 77B. However, when the displaceable portion 100 is moved to the alternate position illustrated in dashed lines, the slide assemblies 70 can freely slide on the corresponding rods 77A and 77B. In this manner, the spoon assemblies 20 can be manually tilted upwardly for service or inspection. In the embodiment illustrated, the displaceable portion 100 slides on cross members 102A and 102B. Suitable interlock devices are provided to detect when the displacement portion 100 has moved away from its position illustrated in solid lines. The interlock devices can be switches that control power to the drive motor of the conveyor 16. The interlock devices thus prevent operation of the dough packing apparatus 10 when the possibility exists that the guide rollers 76 for the some of spoon assemblies 20 may not be properly aligned with the spaced between rail portions 80 and 88.

In operation, the dough packing apparatus 10 includes a sufficient number of spoon assemblies 20 to form the endless conveyor 16. Referring to FIGS. 1–4, progression of the spoon assemblies 20 is as follows. A dough product to be packaged is deposited on the spoon 26, while a container is deposited on the container holder 28 in the retracted position of FIG. 3. As the spoon assembly 20 moves to the left in FIG. 1, the guide roller 76 will enter the space between guide rail portions 80 and 88. As the guide roller 76 is guided between guide rail portions 80 and 88, the slide assembly 70 will slide toward the hinge 27 on the support rail 77A and 77B, thereby displacing the spoon 26 and container holder 28 to the inclined position of FIG. 4. The container present on the container holder 28 is held substantially stationary with respect to the container holder 28 by a suitable support, not shown, as the guide roller 76 is guided by the guide rail portions 80 and 88. In the inclined position, the dough product slides down the spoon 26 and into the container. Once the dough product has been deposited in the container, the container is transferred to another conveyor assembly, not shown, for further processing. The guide rail portions 80 and 88 guide the guide roller 76 and, thus, the slide assembly 70 back to the retracted position of FIG. 3 as the spoon assembly 20 approaches the end of the dough packing apparatus 10 proximate the drive shaft 35B.

The spoon assembly 20 is then conveyed around the drive shaft 35B where the guide roller 76 contacts the end guide rail portion 90, which retains the spoon assembly in the retracted position. The spoon assembly 20 is then conveyed along the lower section 86 of the dough packing apparatus 10 and retained in the retracted position by the guide rail portion 84. At the end of the dough packing apparatus 10 proximate the drive shaft 35A, the spoon assembly 20 is again returned to the upper section 82 of the dough packing apparatus wherein the end rail portion 92 retains the spoon assembly 20 in the retracted position while being conveyed around the drive shaft 35A.

Although the present invention has been described with reference to preferred embodiments, workers skilled in the art will recognize that changes may be made in form and detail without departing from the spirit and scope of the invention.

What is claimed is:

1. An apparatus for loading dough into a container through a container opening, the apparatus comprising:

a support frame;

a cam rail mounted to the support frame;

an endless band rotatable on the support frame; and a plurality of tilting spoon assemblies mounted to the band, each tilting spoon assembly comprising:

a support member fixed to the band;

a spoon having a first end and a second end;

a hinge proximate the first end and joining the spoon to the support member; and a push bar having a spoon end joined to the spoon at a position between the second end of the spoon and the hinge, and a rail end engaging the cam rail, the cam rail having bends to cause selective displacement of the push bar to tilt the spoon from a first position to a second position relative to the associated support member.

2. The apparatus of claim 1 wherein the push bar is pivotally joined to the spoon.

3. The apparatus of claim 1 wherein each spoon assembly includes an end member pivotally joined to the push bar at the rail end, the end member engaging the cam rail.

4. The apparatus of claim 3 wherein each end member is guided on the associated support member.

5. The apparatus of claim 4 wherein each end member is slidably guided on the associated support member.

6. The apparatus of claim 5 wherein the support member comprises spaced-apart parallel bars, and wherein each end member slide on the spaced-apart parallel bars.

7. The apparatus of claim 3 wherein the end member includes a roller engaging the cam rail.

8. The apparatus of claim 3 wherein the cam rail includes a first portion on an upper section of the support frame having the bends to cause selective displacement, and a second portion on a lower portion for retaining the spoon assemblies upside down in the first position.

9. The apparatus of claim 8 wherein the cam rail includes a third portion on the upper section, the third portion having bends similar to the first portion to be substantially parallel to the first portion, the end member being guided by the first and third portions.

10. The apparatus of claim 9 wherein the cam rail includes end portions at opposite ends of the support frame for guiding the end members between the first portion and the second and retaining the spoon assemblies in the first position.

11. The apparatus of claim 10 wherein the first and second portions are each disposed in a plane parallel to a plane of movement of the spoon assemblies.

12. The apparatus of claim 10 wherein one of the end portions joins the second portion to the third portion.

13. The apparatus of claim 11 wherein the cam rail includes a straight portion in a section of the first portions having the bends, and wherein at least some of the spoon support members include a guide member in engagement with the straight portion during pivotal movement of the spoon.

14. The apparatus of claim 1 wherein the endless band comprises spaced-apart chains and wherein the support members are attached to the chains at opposite ends.

15. An apparatus for loading dough into a container through a container opening, the apparatus comprising:

a support frame;

a cam rail mounted to the support frame, the cam rail comprising a first portion disposed on an upper section of the support frame and a second portion disposed on a lower section;

an endless band rotatable on the support frame; and a plurality of tilting spoon assemblies mounted to the band, each tilting spoon assembly comprising:

a support member fixed to the band;

a spoon having a first end and a second end, the spoon being pivotally attached to the support member proximate the second end; and a push bar having a spoon end joined to the spoon, and a rail end engaging the portions of the cam rail, the first portion having bends to cause selective displacement of the push bar to tilt the spoon from a retracted position, where the first end of the spoon is closer to the associated support member, to a tilted position where the first end is farthest from the associated support member, the first portion of the cam rail being disposed beneath the spoons in the retracted position.

16. The apparatus of claim 15 wherein the push bar is pivotally joined to the spoon.

17. The apparatus of claim 15 wherein each spoon assembly includes an end member pivotally joined to the push bar at the rail end, the end member engaging the cam rail.

18. The apparatus of claim 17 wherein each end member is guided on the associated support member.

19. The apparatus of claim 18 wherein each end member is slidably guided on the associated support member.

20. The apparatus of claim 17 wherein the cam rail includes a third portion on the upper section, the third portion having bends similar to the first portion to be substantially parallel to the first portion, the end member being guided by the first and third portions.

21. The apparatus of claim 20 wherein the cam rail includes end portions at opposite ends of the support frame for guiding the end members between the first portion and the second portion and retaining the spoon assemblies in the retracted position.

22. The apparatus of claim 21 wherein the first and second portions are each disposed in a plane parallel to a plane of movement of the spoon assemblies.

23. The apparatus of claim 21 wherein one of the end portions joins the second portion to the third portion.

24. The apparatus of claim 22 wherein the cam rail includes a straight portion in a section of the first portions having the bends, and wherein at least some of the spoon support members include a guide member in engagement with the straight portion during pivotal movement of the spoon.

* * * * *

UNITED STATES PATENT AND TRADEMARK OFFICE

CERTIFICATE OF CORRECTION

PATENT NO. : 6,044,617
DATED : April 4, 2000
INVENTOR(S) : Finkowski et al.

It is certified that error appears in the above-identified patent and that said Letters Patent is hereby corrected as shown below:

Column 6,
Line 43, "second and retaining" should be -- second portion and retaining --

Signed and Sealed this

Seventh Day of May, 2002

*Attest:*

*Attesting Officer*

JAMES E. ROGAN
*Director of the United States Patent and Trademark Office*